US009524611B2

(12) United States Patent
Weitzen et al.

(10) Patent No.: US 9,524,611 B2
(45) Date of Patent: Dec. 20, 2016

(54) ELECTRONIC GAMING DEVICE WITH BONUS ELEMENT SELECTIONS

(71) Applicant: Cadillac Jack, Inc., Duluth, GA (US)

(72) Inventors: Christopher James Weitzen, Atlanta, GA (US); Eric Michael Lothspeich, Austin, TX (US); Enock Etienne, Lilburn, GA (US); Steven W. Davis, Suwanee, GA (US); Dmitry M. Gerenrot, Alpharetta, GA (US)

(73) Assignee: Cadillac Jack, Inc., Duluth, GA (US)

( * ) Notice: Subject to any disclaimer, the term of this patent is extended or adjusted under 35 U.S.C. 154(b) by 668 days.

(21) Appl. No.: 13/651,585

(22) Filed: Oct. 15, 2012

(65) Prior Publication Data

US 2014/0106845 A1 Apr. 17, 2014

(51) Int. Cl.
*G07F 17/32* (2006.01)

(52) U.S. Cl.
CPC ..... *G07F 17/3244* (2013.01); *G07F 17/3262* (2013.01)

(58) Field of Classification Search
CPC ..... G07F 17/3262; G07F 17/3244
See application file for complete search history.

(56) References Cited

U.S. PATENT DOCUMENTS

2008/0153570 A1* 6/2008 Esses et al. ..... 463/20

OTHER PUBLICATIONS

"Wikia Bloons Tower Defense 4 (Game)" available at https://web.archive.org/web/20111008140053/http://bloons.wikia.com/wiki/Bloons_Tower_Defense_4_(Game); publicly available Oct. 8, 2011, last accessed Apr. 17, 2015.*
"Bloons Tower Defense 4: Expert Track (Hard)—Rounds 1-75 Video Tutorial" by PcwizWorld, available at https://www.youtube.com/watch?v=uiU8xWuBmq0, published Dec. 4, 2009, last accessed Apr. 17, 2015.*
"Tower defense" by Wikipedia available at https://web.archive.org/web/20110218151049/http://en.wikipedia.org/wiki/Tower_Defense publicly available Feb. 18, 2011, last accessed Apr. 17, 2015.*
xCTSGx, "Cursed Treasure: Don't Touch My Gems!—level 15 Brilliant," May 14, 2010, available at https://www.youtube.com/watch?v=XsSJhFZbrFM, last accessed Feb. 12, 2016.*
Cursed Treasure Walthrough—Tower Types, avaiable at least as early as Jun. 7, 2010, available at https://web.archive.org/web/20100607062815/http://www.engineering.com/GamesPuzzles/CursedTreasure/CursedTreasureWalkthroughTowerTypes.aspx, last accessed Feb. 12, 2016.*

* cited by examiner

*Primary Examiner* — Jay Liddle
(74) *Attorney, Agent, or Firm* — Weide & Miller, Ltd.

(57) ABSTRACT

Examples disclosed herein relate to systems and methods, which may receive wagers on one or more paylines. The systems and methods may utilize one or more selectable objects. The systems and methods may determine one or more payouts based on the one or more selectable objects. The systems and methods may display one or more presentations based on the one or more selectable objects.

12 Claims, 13 Drawing Sheets

ELECTRONIC GAMING DEVICE WITH BONUS ELEMENT SELECTIONS

FIELD

The subject matter disclosed herein relates to an electronic gaming device. More specifically, the disclosure relates to an electronic gaming device, which provides gaming functionality relating to bonus element selections. Further, the disclosure relates to selecting elements in a bonus game, which generate one or more entertainment presentations and determine the outcome of one or more bonus events.

Information:

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successful matches the predetermined winning symbols in one of the predetermined patterns. One or more combinations of symbols may generate a bonus game. A new way of delivering game play includes providing one, a few, and/or a plurality of different bonus game elements, which may be selected by the player to determine an outcome and a presentation. These bonus game elements may increase the excitement of game play because the player would be able to select which elements the presentations and game results would be based on.

BRIEF DESCRIPTION OF THE FIG.URES

Non-limiting and non-exhaustive examples will be described with reference to the following figures, wherein like reference numerals refer to like parts throughout the various figures.

DETAILED DESCRIPTION

Figure 1:
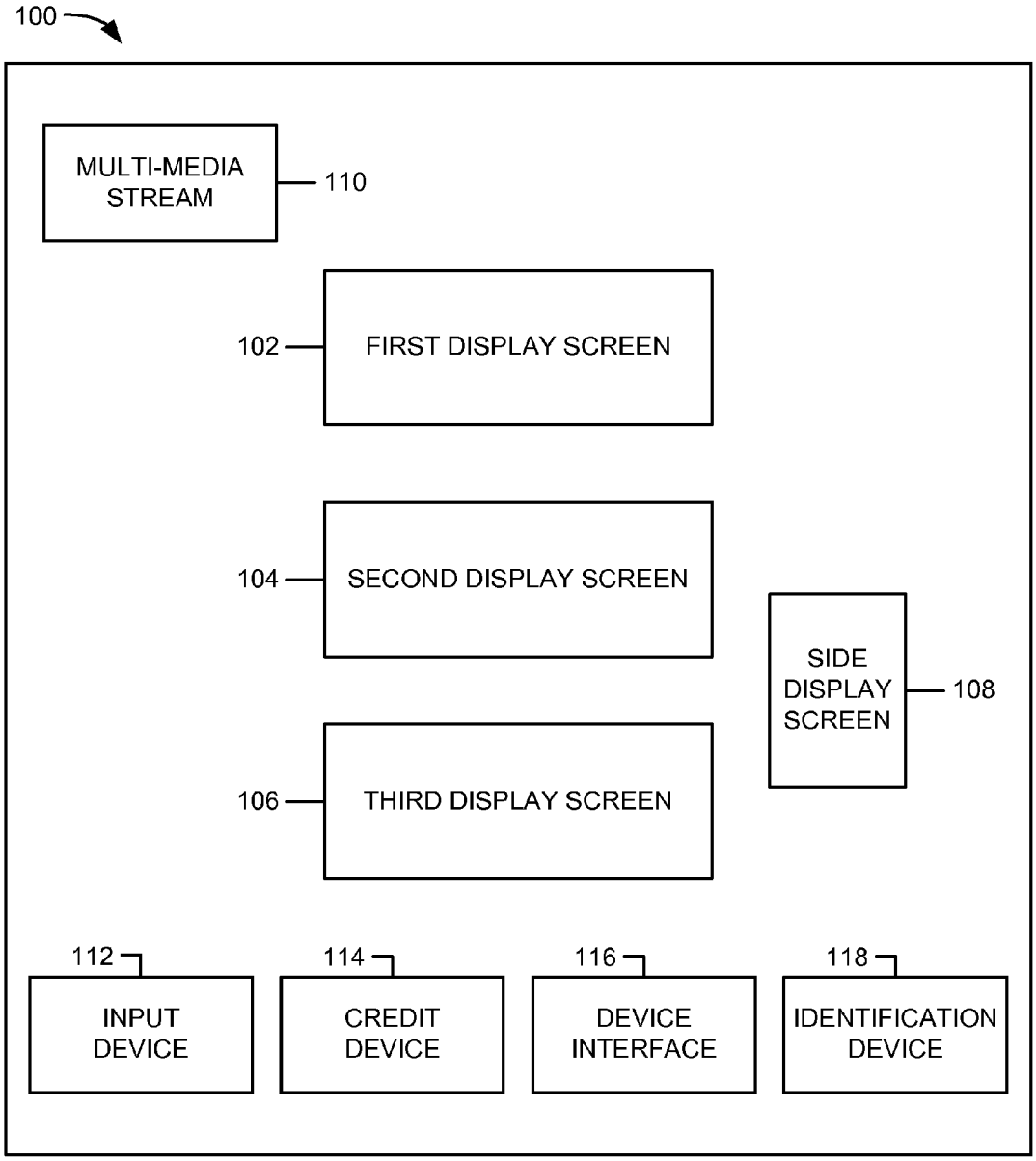
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to make a wager, to select one or more game (e.g., base and/or bonus) elements, to select one or more pattern gaming options, to obtain data relating to historical payouts, to select a row and/or column to move, to select a row area to move, to select a column area to move, to select a symbol to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.).

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more game element selection options may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, a player may want to have game play which has game element selection options only. Therefore, no games without game element selection options would be presented. In another example, the player may only want to play games that include pattern gaming options only. Therefore, only games which include pattern gaming options would be presented to the player. In another example, the player may only want to play games that include historical information relating to game play. Therefore, only games which include historical gaming data would be presented to the player.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multimedia data, which may be displayed on any display combination.

Figure 2:
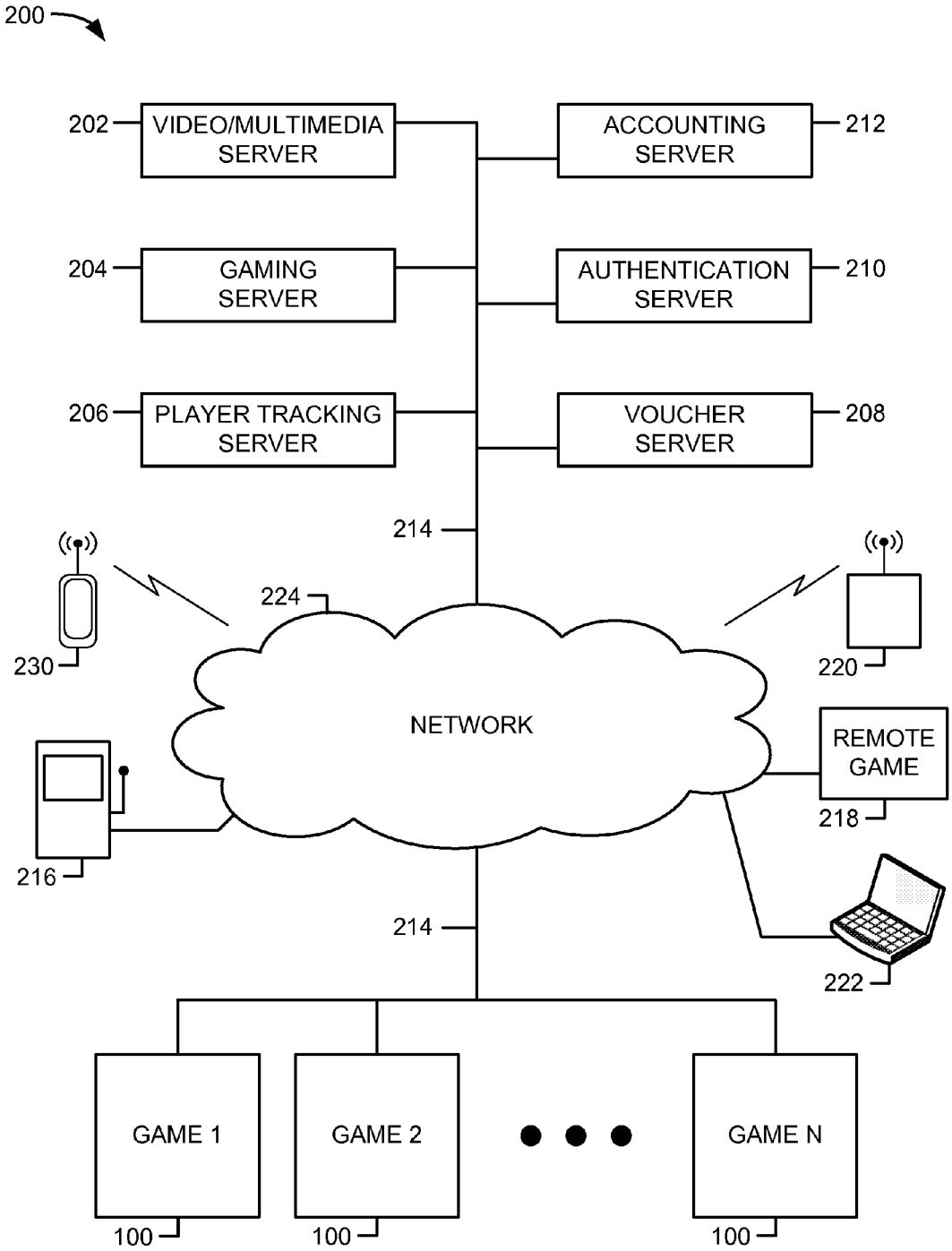
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of a payout functionality, a weapons functionality (e.g., a first object functionality), a weapons location functionality, a weapons aiming functionality (e.g., a first object's characteristic functionality), a pathway functionality (e.g., a second object's characteristic functionality), and an enemy functionality (e.g., a second object functionality).

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include game element selection data, repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Statistics server may include data relating to one or more game element selections. This data may include the number of time a specific element was selected. The frequency of any specific element being selected and the amount won. This data may also include data relating to any interrelationship of elements. For example, when weapon 1 is selected (e.g., first object), weapon 3 is selected 85% of the time (e.g., second object). In another example, when weapon 2 is selected (e.g., third object), a targeting range of medium is selected 24% of the time (e.g., third object characteristic). Further, a targeting range (e.g., left, right, middle, etc.) to the right is selected 45% of the time (e.g., another third object characteristic).

Figure 3:
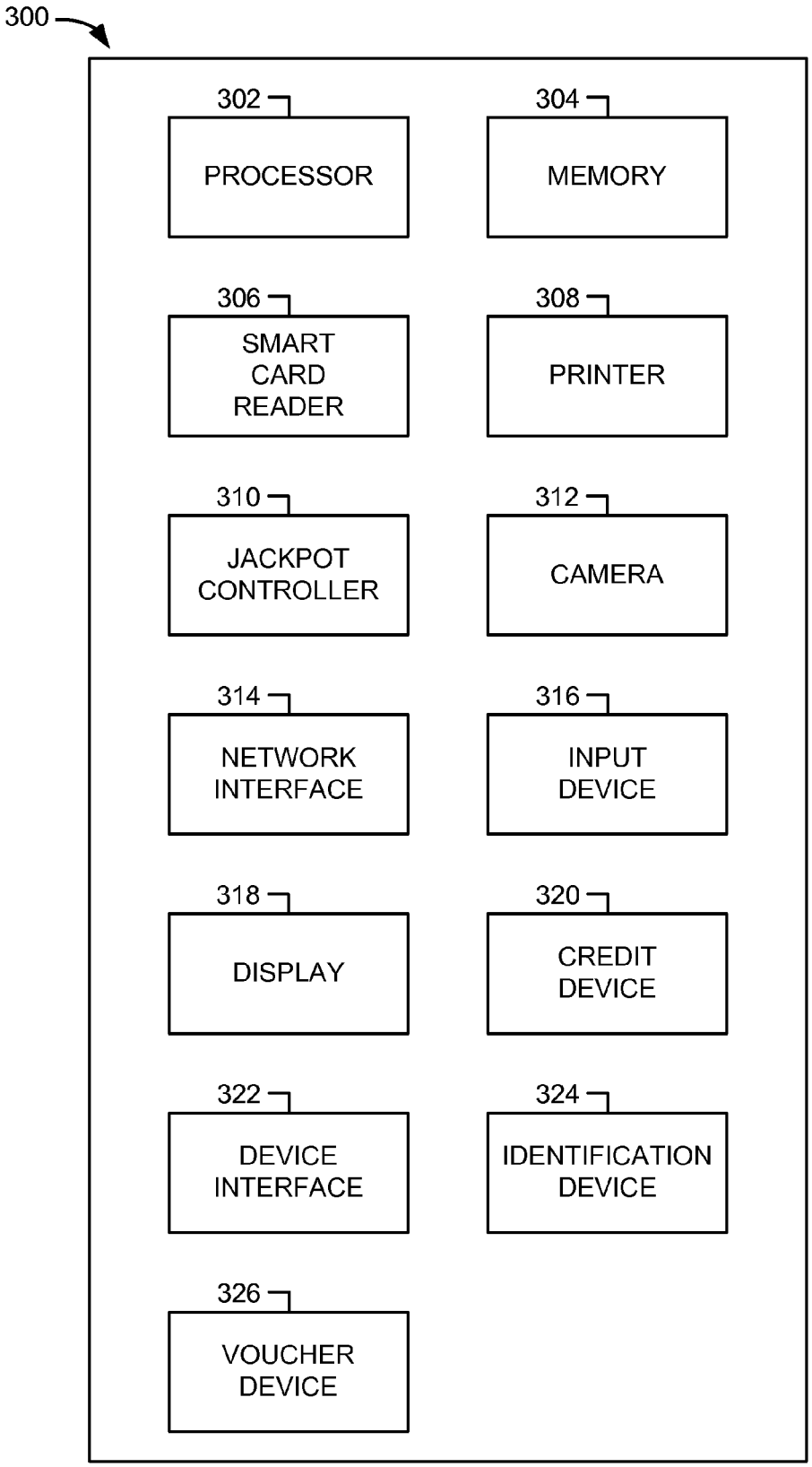
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine their picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof. Input device 316 may be utilized to make a wager, to select one or more game elements, to make an offer to buy or sell a voucher, to determine a vouchers worth, to cash in a voucher, to modify electronic gaming device 100 (e.g., change sound level, configuration, font, language, etc.), to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
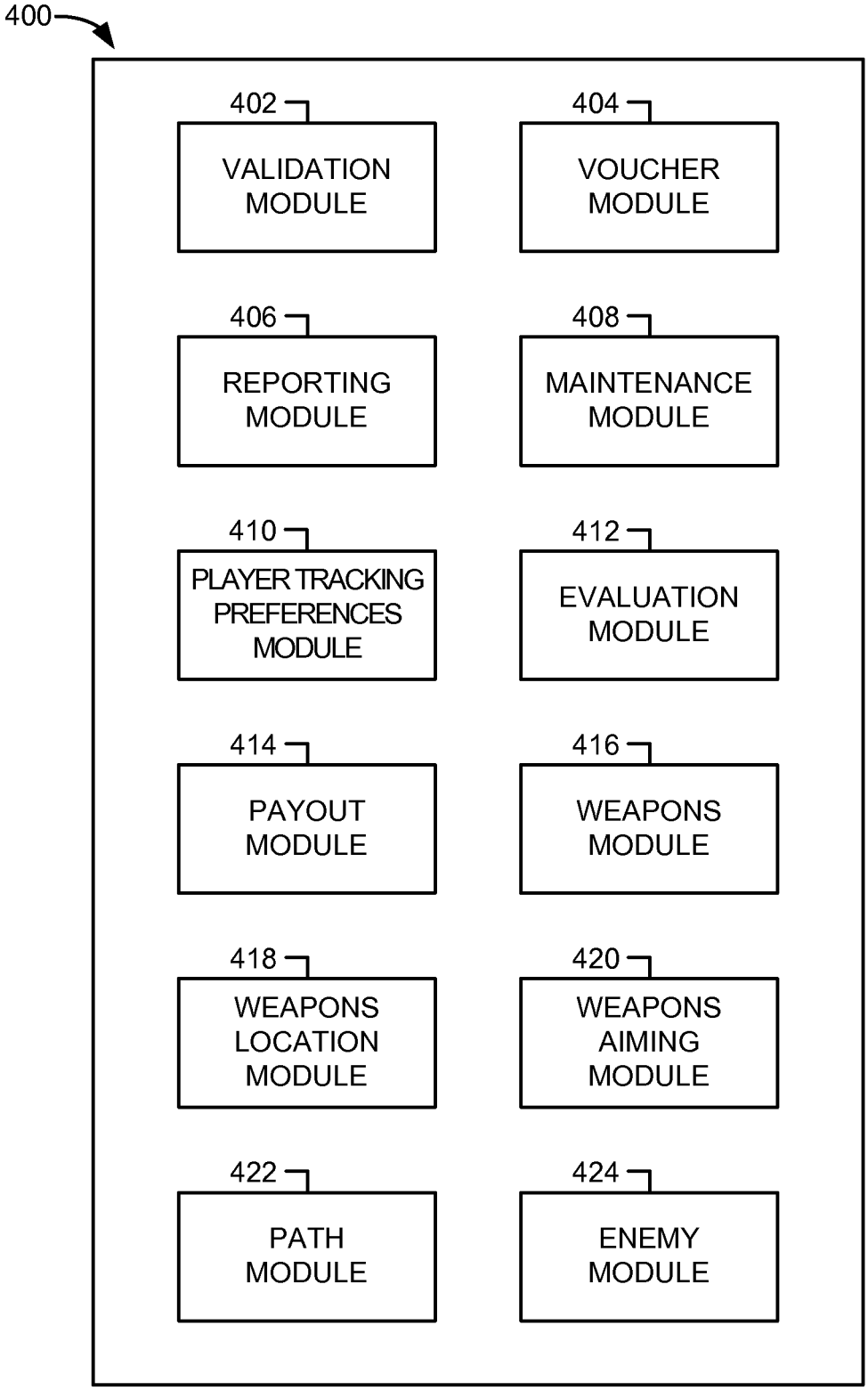
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an evaluation module 412, a payout module 414, a weapons module 416, a weapons location module 418, a weapons aiming module 420, a path module 422, and an enemy module 424.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Evaluation module 412 may evaluate game play in either a base game and/or a bonus game. Evaluation module 412 may store a plurality of payout structures.

Payout module 414 may determine payouts in either a base game and/or a bonus game. Payout module 414 may include data relating to a plurality of payouts.

Weapons module 416 may include data relating to one or more weapons. Weapons module 416 may include data relating to one or more characteristics for the one or more weapons.

Weapons location module 418 may include data relating to one or more weapons locations. Weapons location module 418 may include data relating to one or more characteristics (e.g., height, slope, etc.) for the one or more weapons locations.

Weapons aiming module 420 may include data relating to one or more weapons aiming function. Weapons aiming module 418 may include data relating to one or more characteristics (e.g., streaming shots, shells, accuracy, spread, etc.) for the one or more weapons aiming function.

Path module 422 may include data relating to various paths that may be utilized on the game play path, one or more speeds that may be utilized by objects on the game play path, one or more obstacles on the game play path, and/or any other data relating to the game play path.

For example, one or more objects may travel along a path that has one or more obstacles (e.g., water, pond, river, lake, mud, quick sand, a trap door, hurdles, trees, trees falling, barrels rolling down a hill, boulders rolling down a hill, catapult (with flaming rocks, rocks, watermelons, boulders, etc.), pit hole, pit hole with crocodiles or other animals, pit hole with water, pit hole with mud, pit hole with sharp objects, pit hole with quicksand, etc.). The first obstacle (e.g., mud) may slow down the object's speed (e.g., 2 miles an hour to 1 mile an hour) traveling along the path. The second obstacle (e.g., quick sand) may stop the object from further travels. The third obstacle (e.g., trap door) may delay the object for a specific time.

In another example, the amount of object that are successful and/or are stopped may determine a payout. For example, the more objects that are successful in traveling through the path may increase a prize value. Whereas, the more objects that are stopped by one or more objects (e.g., weapons) may increase a prize value.

Enemy module 424 may include data relating to an enemy's characteristics (e.g., size, color, image, speed, strength, health, recovery powers, etc.), one or more paths that may be taken by the enemy, one or more speeds the enemy may move at, a jumping ability, a swinging ability, and/or any other characteristics.

Weapons may have different characteristics, such as, load time, damage levels, firing times, accuracy, armor, upgradable, weapon degeneration, etc. Weapons may be skill based, which may require a player to provide input (e.g., aiming, etc.).

For example, a player may push a jump button to jump over an object (e.g., hurdle, a pool of water, a river, a hole, etc.). Based on when the player pushes the jump button may determine whether the image has a successfully jump. In another example, the player may aim a weapon at one or more objects and based on the player's aim may determine whether the one or more objects are hit. In another example, the player may drive a car on a road and based on the player's driving input may determine a payout.

In one example, there are three locations along the path on which to place 3 of 4 different weapons. Each weapon may have a different color: red, blue, green, and yellow. The player may place 3 of the 4 weapons along the path. Each pirate's color matches 1 of the 4 weapons. A pirate that walks past a same-colored weapon may be eliminated. Weapons of a different color may have no effect on the pirate. The player may be awarded credits whenever a pirate is eliminated. The presentation ends when a pirate successfully traverses the path.

It should be noted that any of the enemy modules and/or weapon modules may be replaced by any other object module (e.g., person, machine, tool, animal, etc.).

A bonus module may generate a bonus game, evaluate the results of the bonus game, trigger bonus game presentations, generate bonus game payouts, and/or display any data relating to the bonus game.

A presentation generation module may generate the presentation data (e.g., visual and audio) relating to one or more element selections. A presentation module may display one or more of the generated presentations.

It should be noted that one or more modules may be combined into one module. Further, there may be one evaluation module where the determined payout does not depend on whether there were any wild symbols, scatter symbols, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5A:
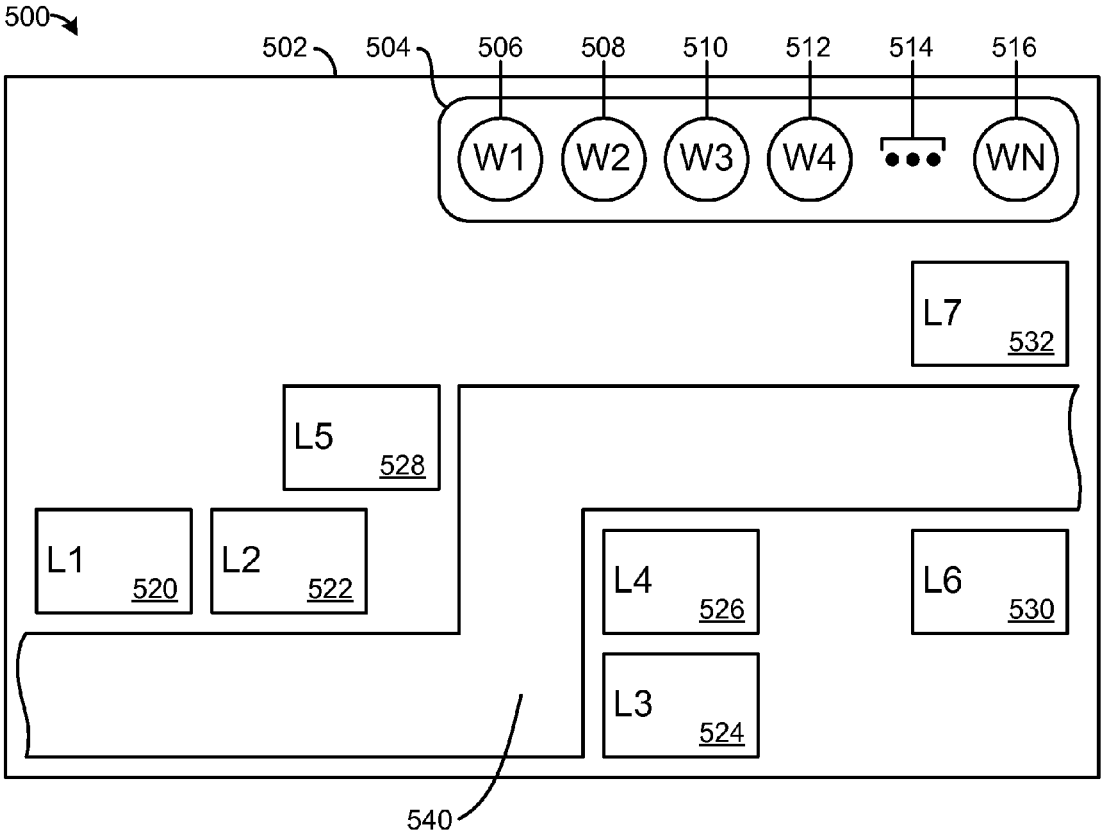
FIG. 5A is an illustration of a bonus element selection game play, according to one embodiment.

FIG. 5A is an illustration of a bonus element selection game play, according to one embodiment. FIG. 5 A shows a screen image 500 for electronic gaming device 100 on display 318. Screen image 500 may include a display area 502, an object selection area 504, a first location 520, a second location 522, a third location 524, a fourth location 526, a fifth location 528, a sixth location 530, a seventh location 532, and a game play path 540. Object selection area 504 may include a first object 506, a second object 508, a third object 510, a fourth object 512, and an $n^{th}$ object 516. There may be up to an $n^{th}$ location.

Object selection area 504 may be a selection area where a player may select one or more objects. These selected objects may be placed on and/or utilized in any area of display area 502. The player may be able to drag the one or more objects and place them at various locations on display area 502.

In one example, first object 506 may be a first weapon, second object 508 may be a second weapon, third object 510 may be a third weapon, fourth object 512 may be a fourth weapon, and $N^{th}$ object 516 may be an $N^{th}$ weapon.

In one embodiment, a player, electronic gaming device 100, and/or electronic gaming system 200 may select one or more of first object 506 (e.g., first weapon in this example), second object 508 (e.g., second weapon in this example), third object 510 (e.g., third weapon in this example), fourth object 512 (e.g., fourth weapon in this example), and/or $N^{th}$ object 516 (e.g., $N^{th}$ weapon in this example). Player, electronic gaming device 100, and/or electronic gaming system 200 may move first object 506, second object 508, third object 510, fourth object 512, and/or $N^{th}$ object 516 from object selection area 504 to one or more of first location 520, second location 522, third location 524, fourth location 526, fifth location 528, sixth location 530, and/or seventh location 532.

Game play path 540 may be where one or more game stopping elements appear (e.g., enemies), which may be eliminated by one or more of first object 506, second object 508, third object 510, fourth object 512, and/or $N^{th}$ object 516.

It should be noted that the objects may be any item (e.g., a person, a weapon, a structure, an animal, a vehicle, a tool, an instrument, a natural feature (e.g., hill, mountain, lake, sea, etc.), a machine, and/or any other item).

For example, first object 506 may be a first person, second object 508 may be a second person, third object 510 may be a third person, fourth object 512 may be a fourth person, and $N^{th}$ object 516 may be an $N^{th}$ person.

In another example, first object 506 may be a first person, second object 508 may be a first weapon, third object 510 may be a second person, fourth object 512 may be a first animal, and $N^{th}$ object 516 may be an $N^{th}$ person.

Game data area (not shown) may include additional data relating to the games. For example, a game menu, a bet amount, a winning total, a credit total, a betting increment (e.g., $0.01 per credit), an input button (e.g., select, play, deal, draw, etc.), and/or any other gaming data may be shown.

Game menu button may include data relating to the game. For example, the payout structures, payout odds, the amount won over a predetermined number of game plays, the amount won over a specific time frame, and/or any other game play data may be accessed via game menu button. Game menu button may be utilized to change the game from a first game (e.g., slot machine theme 1) to a second game (e.g., slot machine theme 2, poker, blackjack, roulette, baccarat, craps, etc.). Game menu button may be utilized to change any other game structure (e.g., credit amounts). For example, the credit amount may be increased/decreased between $0.01 to $1.00 and/or any other values.

A bet reducer button (e.g., a downward arrow) may decrease the amount of credits wagered on game play. A bet amount image (e.g., 250) may show the amount of credits wagered on game play. A bet increaser button (e.g., an upward arrow) may increase the amount of credits wagered on game play. A credit amount image (e.g., 207,085) may show the amount of credits available to the player for game play. A win amount area (e.g., 1,000) may show the payout amount of the last event. A credit value image (e.g., $0.01) may show the value of a single credit. A play button may start the next game. A message area may display any message to the player. For example, the message may state "You Won 1,000 Credits. Congratulations!!!!!"

Figure 5B:
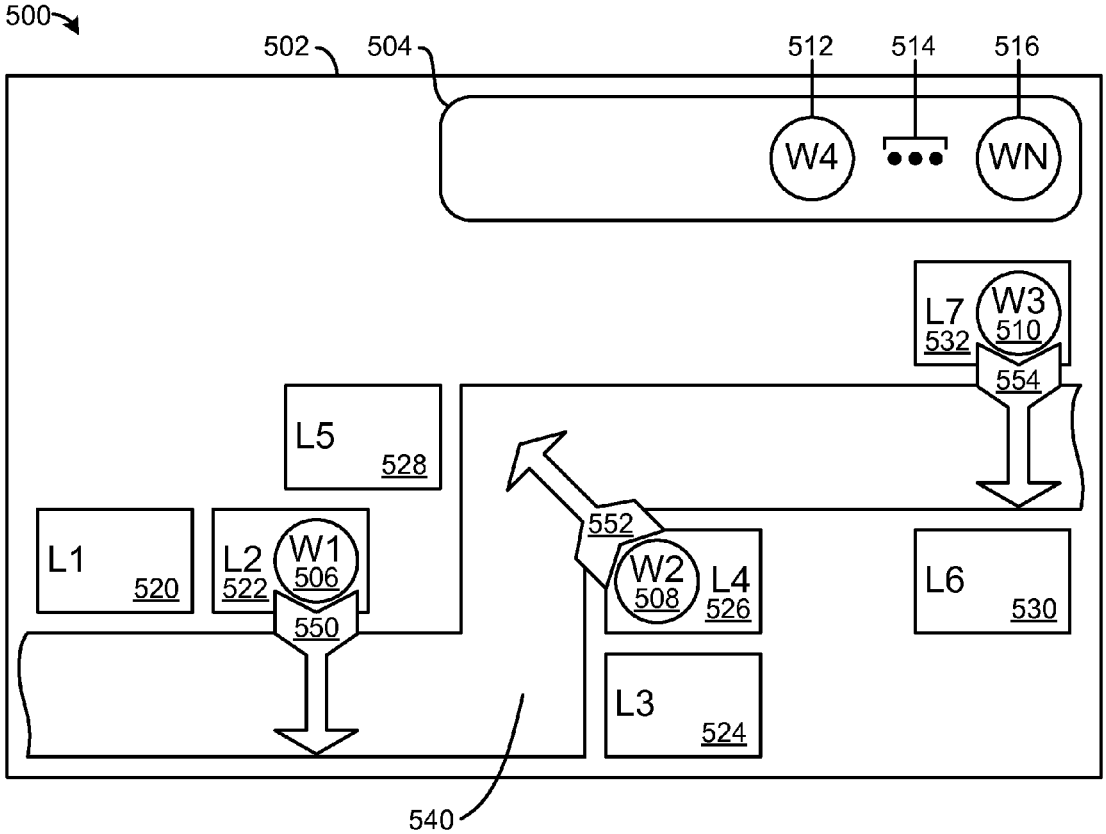
FIG. 5B is another illustration of a bonus element selection game play, according to one embodiment

FIG. 5B is another illustration of a bonus element selection game play, according to one embodiment. In this example, first object 506 (e.g., a cross-bow, a canon, a gun, a rocket launcher, etc.) may be positioned in second location 522 with a first firing range 550. First firing range 550 may have a range which covers the entire vertical path (e.g., 90 degrees) of game play path 540. In this example, second object 508 (e.g., a tank, an airplane, a trap, etc.) may be positioned in fourth location 526 with a second firing range 552. Second firing range 552 may have a range which covers a portion (but not all) of game play path 540. In this example, third object 510 (e.g., a boat, a soldier, etc.) may be positioned in seventh location 532 with a third firing range 554. Third firing range 554 may have a range which covers the entire vertical path (e.g., 90 degrees of game play path 540.

In one example, the player may select three objects from the $n^{th}$ objects available for selection. Any number of characters, weapons, objects, and/or selections may be utilized.

In another example, a multi-level item selection option may be utilized. In one example, if the player selects an item which is a multi-level item, then the player may have the option to select one or more of multi-level selection option. In one example, if a player selects a bow, then there may be a multi-level selection option which may include various types of bows (e.g., long bow, cross bow, etc.) that may be selected by the player that have different characteristics.

In one example, the player may select three weapons from the $n^{th}$ weapons available for selection. If the player makes weapons selection, which included second weapon (e.g., second object 508), third weapon (e.g. third object 510), and fourth weapon (e.g., fourth object 512), then the award amount for this selection may have been 5,000 credits (e.g., 2,500+1,500+1,000=5,000). If the player makes a selection of first weapon (e.g., first object 506), third weapon (e.g., third object 510), and fourth weapon (e.g., fourth object 512), then the award amount may have been 3,500 credits (e.g., 1,000+1,500+1,000=3,500).

In a multi-level selection option example, if the player makes weapons selection, which included second weapon (e.g., second object 508), third weapon (e.g. third object 510), and fourth weapon (e.g., fourth object 512) where the fourth weapon was a multi-level selection option, then the player may have the option to select one or more of a first multi-level weapon selection option, a second multi-level weapon selection option, and/or a third multi-level weapon selection option. If the player selects third multi-level weapon selection option, then the award amount may increase to 6,000 credits (e.g., 2,500+1,500+2,000=6,000) as compared to the non-multi-level weapon selection option (e.g., 5,000). If the player selects second multi-level weapon selection option, then the award amount may increase to 7,000 credits (e.g., 2,500+1,500+3,000=7,000) as compared to the non-multi-level weapon selection option (e.g., 5,000). If the player selects first multi-level weapon selection option, then the award amount may decrease to 4,500 credits (e.g., 2,500+1,500+500=4,500) as compared to the non-multi-level weapon selection option (e.g., 5,000).

Any number of multi-level items may be utilized, along with any number of selections.

Figure 6:
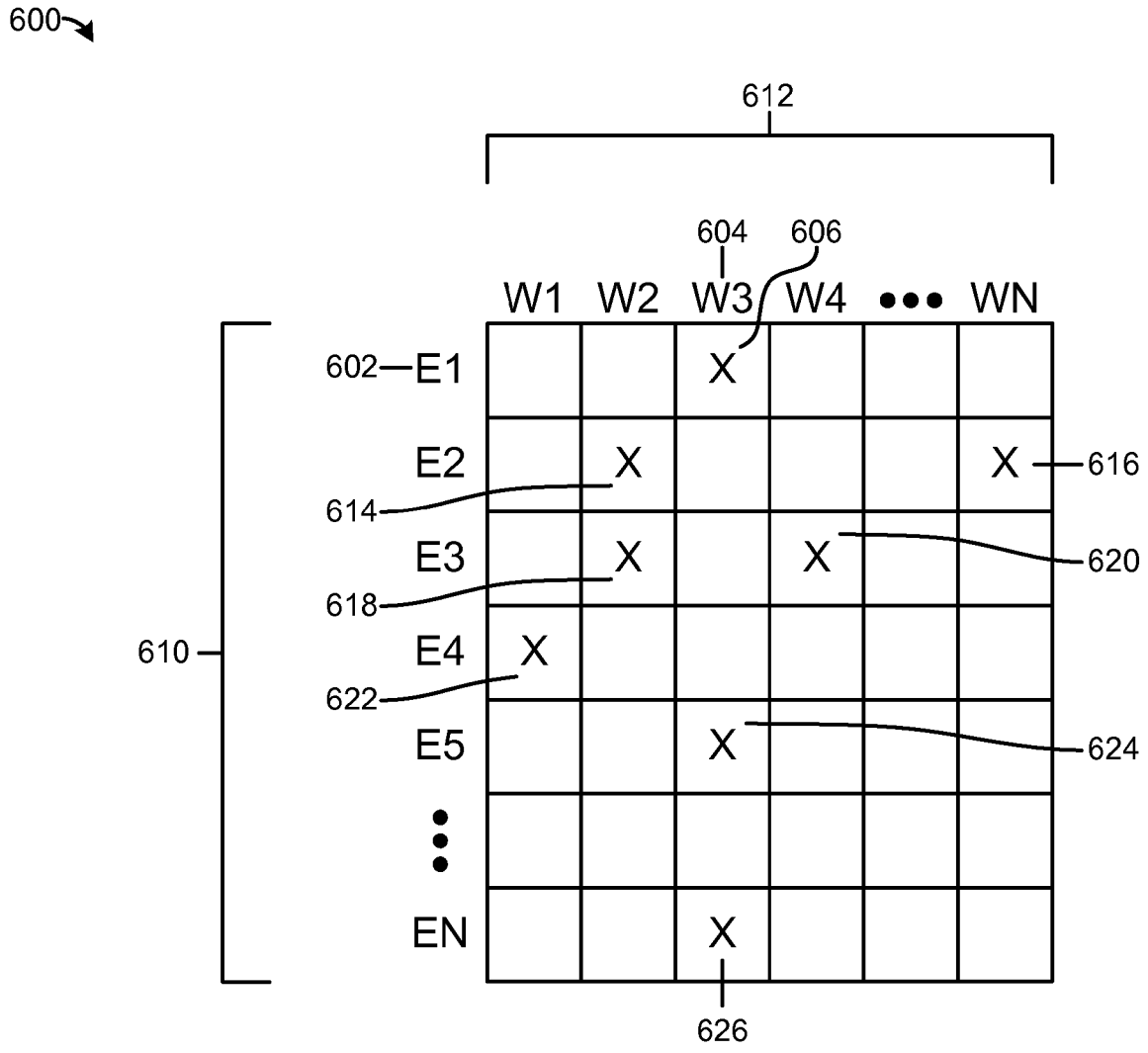
FIG. 6 is a weapon-enemy matrix, according to one embodiment.

FIG. 6 is a weapon-enemy matrix 600, according to one embodiment. Weapon-enemy matrix 600 may include one or more enemy elements (e.g., E1, E2, E3, . . . EN) on an enemy axis 610 (e.g., Y-Axis) and one or more weapon elements (e.g., W1, W2, W3, . . . WN) on a weapon axis 612 (e.g., X-Axis).

In one example, a first enemy element 602 may be related via a first relation element 606 to a third weapon element 604. In this example, first relation element 606 may indicate that third weapon element 604 may eliminate/cancel/neutralize first enemy element 602.

In another example, a second enemy element may be related via a second relation element 614 to a second weapon element. In another example, the second enemy element may be related via a third relation element 616 to a $n^{th}$ weapon element. In this example, second relation element 614 may indicate that second weapon element may eliminate/cancel/neutralize second enemy element. Further, third relation element 616 may indicate that $N^{th}$ weapon element may eliminate/cancel/neutralize second enemy element.

In another example, a third enemy element may be related via a fourth relation element 618 to a second weapon element. In another example, the third enemy element may be related via a fifth relation element 620 to a fourth weapon element. In this example, fourth relation element 618 may indicate that second weapon element may eliminate/cancel/neutralize third enemy element. Further, fifth relation element 620 may indicate that the fourth weapon element may eliminate/cancel/neutralize third enemy element.

In another example, a fourth enemy element may be related via a sixth relation element 622 to a first weapon. In this example, sixth relation element 622 may indicate that first weapon may eliminate/cancel/neutralize fourth enemy element.

In another example, a fifth enemy element may be related via a seventh relation element 624 to third weapon 604. In this example, seventh relation element 624 may indicate that third weapon 604 may eliminate/cancel/neutralize fifth enemy element.

In another example, an $n^{th}$ enemy element may be related via an eighth relation element 626 to third weapon 604. In this example, eighth relation element 626 may indicate that third weapon 626 may eliminate/cancel/neutralize $n^{th}$ enemy element. Enemy element and weapon element may be any element.

In another example, one or more weapons may be required to eliminate/cancel/neutralize one or more enemy elements. For example, a combination of a first weapon and a fourth weapon may be required to eliminate a fourth enemy.

In one example, first weapon may weaken (e.g., slows the enemy down) the fourth enemy and fourth weapon may eliminate the weaken fourth enemy but may not have eliminate a non-weaken fourth enemy.

Weapon-enemy matrix 600 may be any object-to-object matrix. For example, weapon-enemy matrix 600 may be people-animal matrix. In another example, weapon-enemy matrix 600 may be tool-machine matrix.

Figure 7:
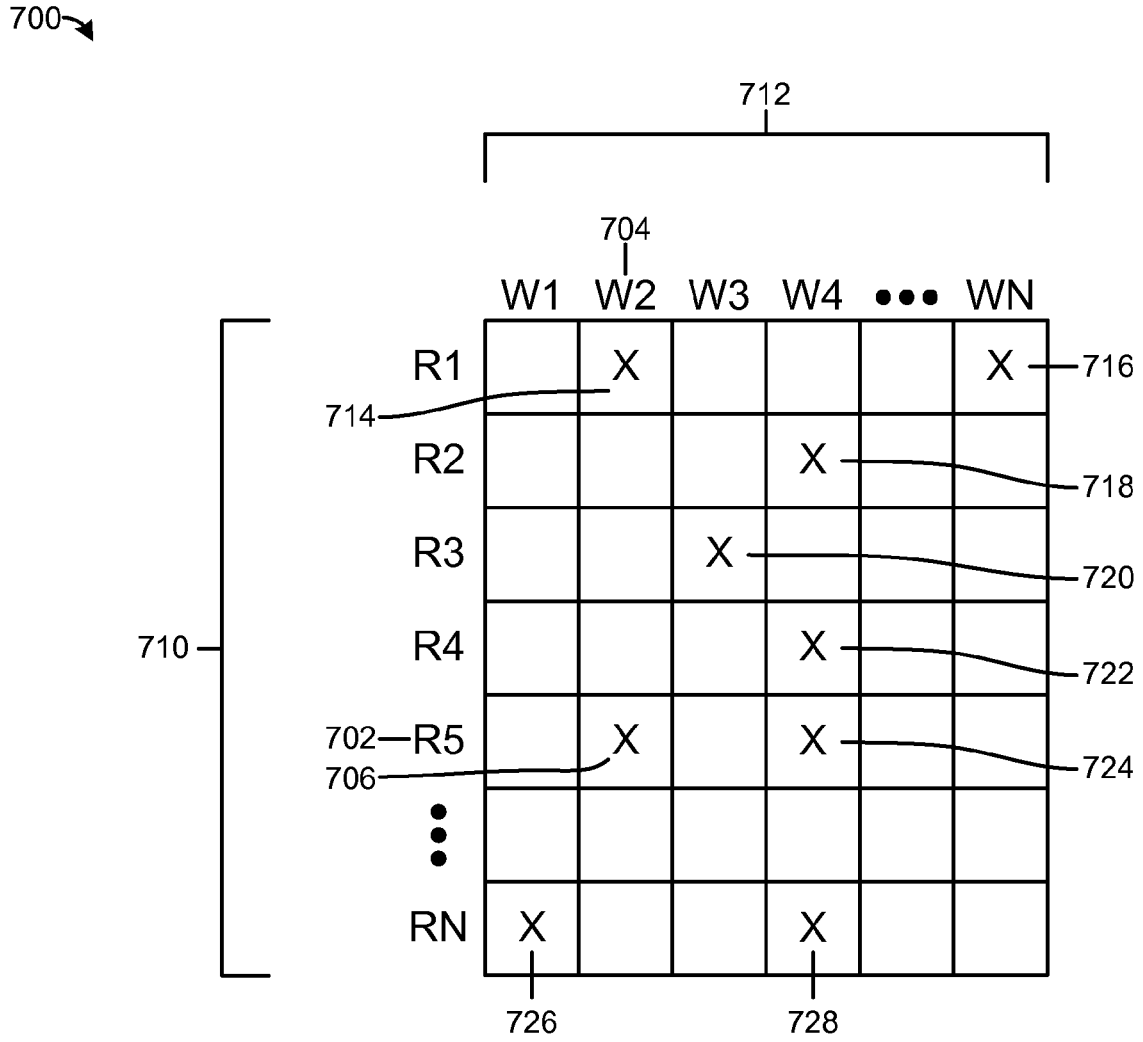
FIG. 7 is a weapon-range matrix, according to one embodiment.

FIG. 7 is a weapon-range matrix 700, according to one embodiment. Weapon-range matrix 700 may include one or more range characteristics (e.g., R1, R2, R3, . . . RN) on a range axis 710 (e.g., Y-Axis) and one or more weapon elements (e.g., W1, W2, W3, . . . WN) on a weapon axis 712 (e.g., X-Axis).

In one example, a second weapon 704 may have one or more range characteristics. In this example, second weapon 704 may have a first range characteristic (e.g., noted by reference number 714) and/or a fifth range characteristic (e.g., noted by reference number 706). First range characteristic may indicate that any enemy, which may be eliminated by second weapon 704 would be eliminated when the enemy is within first range (e.g., a specific area 1). Fifth range characteristic may indicate that any enemy, which may be eliminated by second weapon 704 would be eliminated when the enemy is within fifth range (e.g., a specific area 2).

In one example, a first weapon may have one or more range characteristics. In this example, first weapon may only have an $N^{th}$ range characteristic (e.g., noted by reference number 726). $N^{th}$ range characteristic may indicate that any enemy, which may be eliminated by first weapon would be eliminated when the enemy is within the $n^{th}$ range (e.g., a specific area 3).

In one example, a third weapon may have one or more range characteristics. In this example, the third weapon may only have a third range characteristic (e.g., noted by reference number 720). Third range characteristic may indicate that any enemy, which may be eliminated by third weapon would be eliminated when the enemy is within the third range (e.g., a specific area 4).

In one example, fourth weapon may have one or more range characteristics. In this example, fourth weapon may have a second range characteristic (e.g., noted by reference number 718), a fourth range characteristic (e.g., noted by reference number 722), a fifth range characteristic (e.g., noted by reference number 724), and/or an $N^{th}$ range characteristic (e.g., noted by reference number 728). Second range characteristic may indicate that any enemy, which may be eliminated by the fourth weapon would be eliminated when the enemy is within the second range. Fourth range characteristic may indicate that any enemy, which may be eliminated by the fourth weapon would be eliminated when the enemy is within the fourth range. Fifth range characteristic may indicate that any enemy, which may be eliminated by the fourth weapon would be eliminated when the enemy is within fifth range. $N^{th}$ range characteristic may indicate that any enemy, which may be eliminated by fourth weapon would be eliminated when the enemy is within the $n^{th}$ range.

In one example, an $n^{th}$ weapon may have one or more range characteristics. In this example, the $N^{th}$ weapon may only have a first range characteristic (e.g., noted by reference number 716). First range characteristic may indicate that any enemy, which may be eliminated by the $n^{th}$ weapon would be eliminated when the enemy is within the first range.

Weapon-range matrix 700 may be any object-to-object characteristic matrix. For example, weapon-range matrix 700 may be people-movement speed matrix. In another example, weapon-range matrix 700 may be automotive-handling matrix.

Figure 8A:
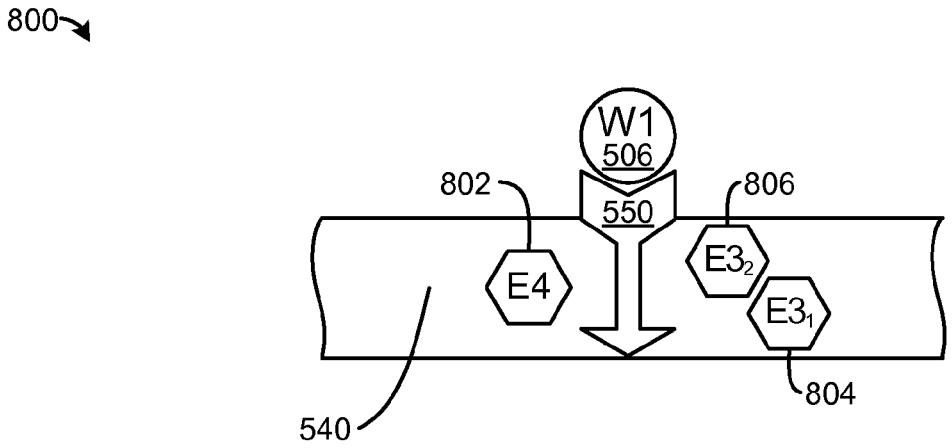
FIG. 8A is an illustration of a weapon-enemy interaction, according to one embodiment.

FIG. 8A is an illustration of a weapon-enemy interaction, according to one embodiment. A first image 800 may include game play path 540. On game play path 540, a first enemy 802 (e.g., a first object), first weapon 506, first firing range 550, a second enemy 804 (e.g., a second object), and a third enemy 806 (e.g., a third object) may be shown.

In this example, second enemy 804 and third enemy 806 have moved by first weapon 506 and through first firing range 550 without being stopped. In contrast, first enemy 802 has been stopped (e.g., eliminated) by first weapon 506 via first firing range 550.

Figure 8B:
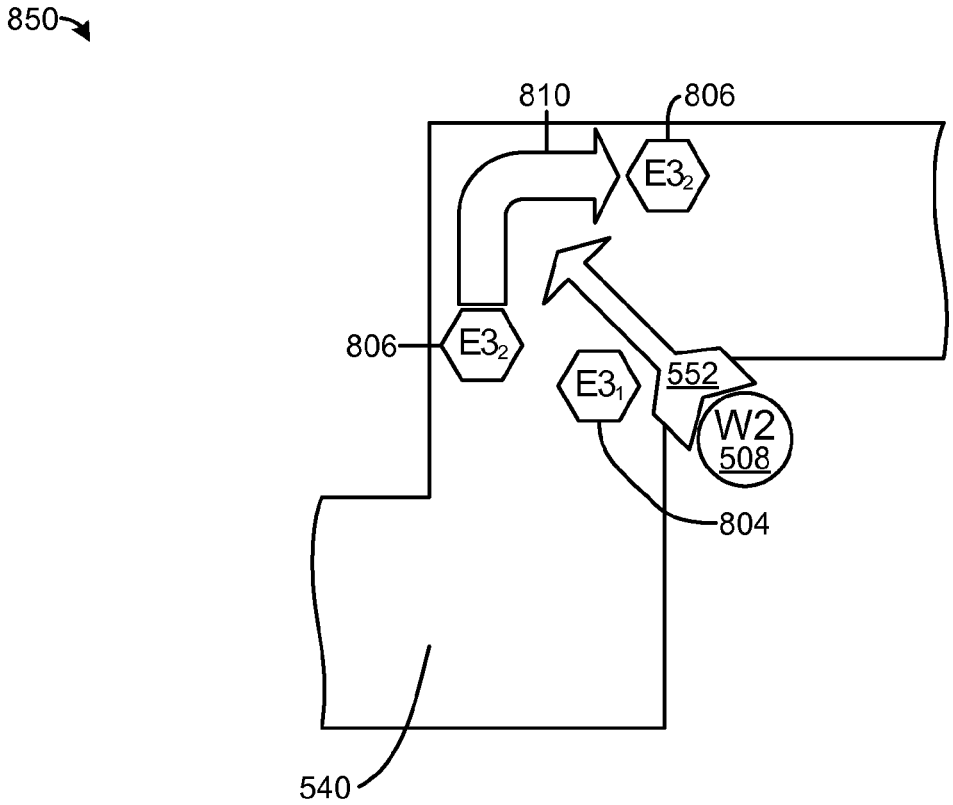
FIG. 8B is another illustration of a weapon-enemy interaction, according to one embodiment.

FIG. 8B is another illustration of a weapon-enemy interaction, according to one embodiment. A second image 850 may include game play path 540. On game play path 540, second enemy 804, second weapon 508, second firing range 552, and third enemy 806 may be shown.

In this example, second enemy 804 has been stopped (e.g., eliminated) by second weapon 504 via second firing range 552. Third enemy 806 has moved by second weapon 508 and through second firing range 552 without being stopped via a first path 810.

Figure 9A:
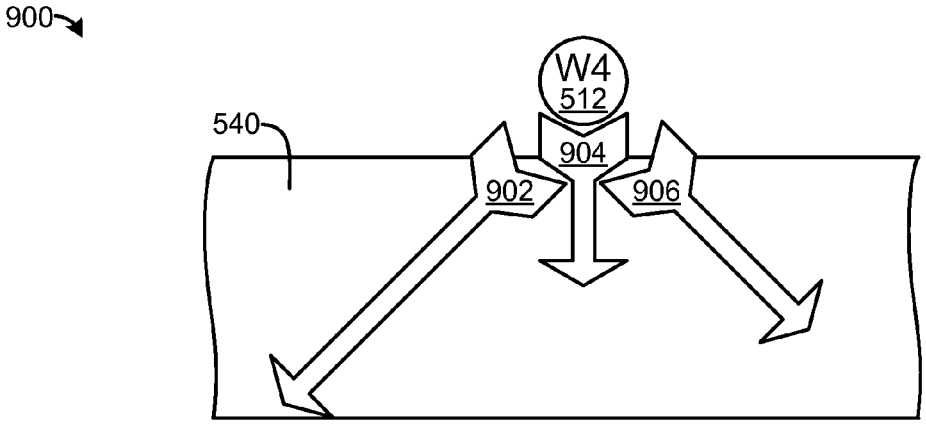
FIG. 9A is an illustration of a weapon-range interaction, according to one embodiment.
Figure 9B:
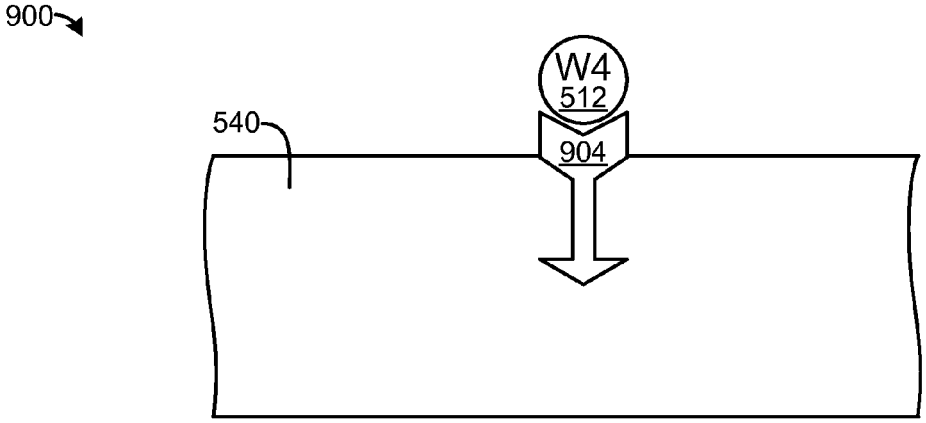
FIG. 9B is another illustration of a weapon-range interaction, according to one embodiment.
Figure 9C:
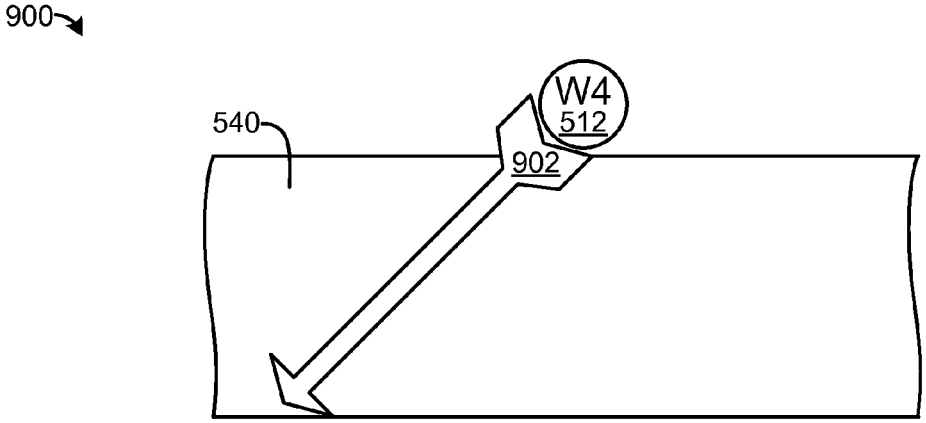
FIG. 9C is another illustration of a weapon-range interaction, according to one embodiment.

FIG. 9A is an illustration of a weapon-range interaction 900, according to one embodiment. Weapon-range interaction 900 may include fourth weapon 512, a first firing range 902, a second firing range 904, and a third firing range 906. The player may select one or more of these firing ranges. In one example, the player may select second firing range 904 (see FIG. 9B). The player may not be able to see the entire length of the range before their selection of a range. The player may be able to see the direction of the firing range but may not be able to see the range length. In another example, the player may select first firing range 902 (see FIG. 9C).

Figure 10:
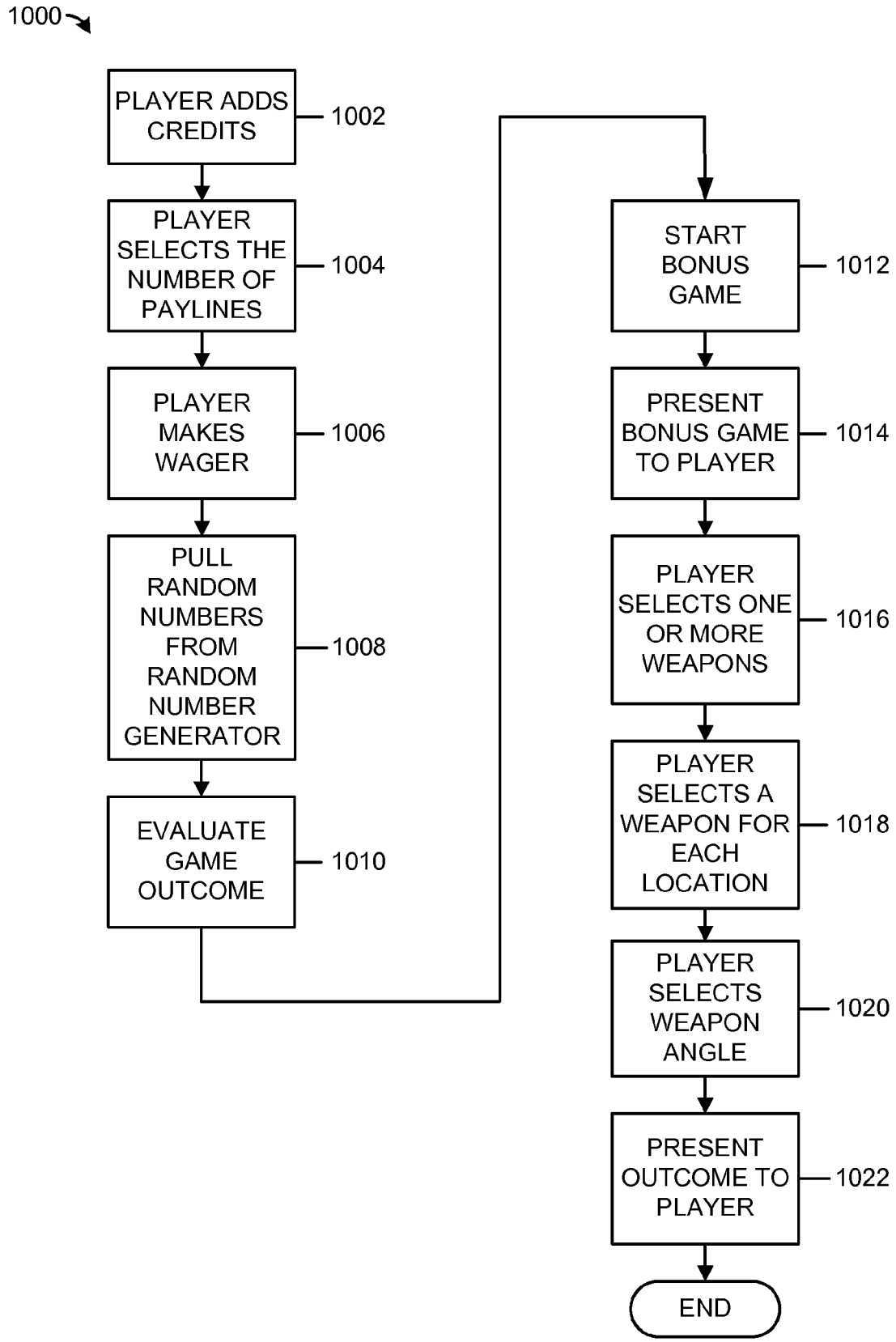
FIG. 10 is a flow diagram for game play, according to one embodiment.

FIG. 10 is a flow diagram for game play 1000, according to one embodiment. The method may include the player adding credits (step 1002). The method may further include the player selecting one or more paylines (step 1004). The method may include the player making a wager on one or more paylines (step 1006). The method may include pulling one or more random numbers via a random number generator (step 1008). The method may include electronic gaming device 100 and/or electronic gaming system 200 evaluating the game outcome (step 1010). The method may include the starting of a bonus game (step 1012). The method may include presenting one or more bonus games to the player (step 1014). The method may include obtaining one or more weapons selections (step 1016). The method may further include obtaining one or more locations for the one or more weapons (step 1018). The method may also include obtaining one or more weapons for each location. The method may include obtaining one or more weapon angles for the one or more weapons (step 1020). The method may include presenting an outcome to a player (step 1022). The method may end.

Figure 11:
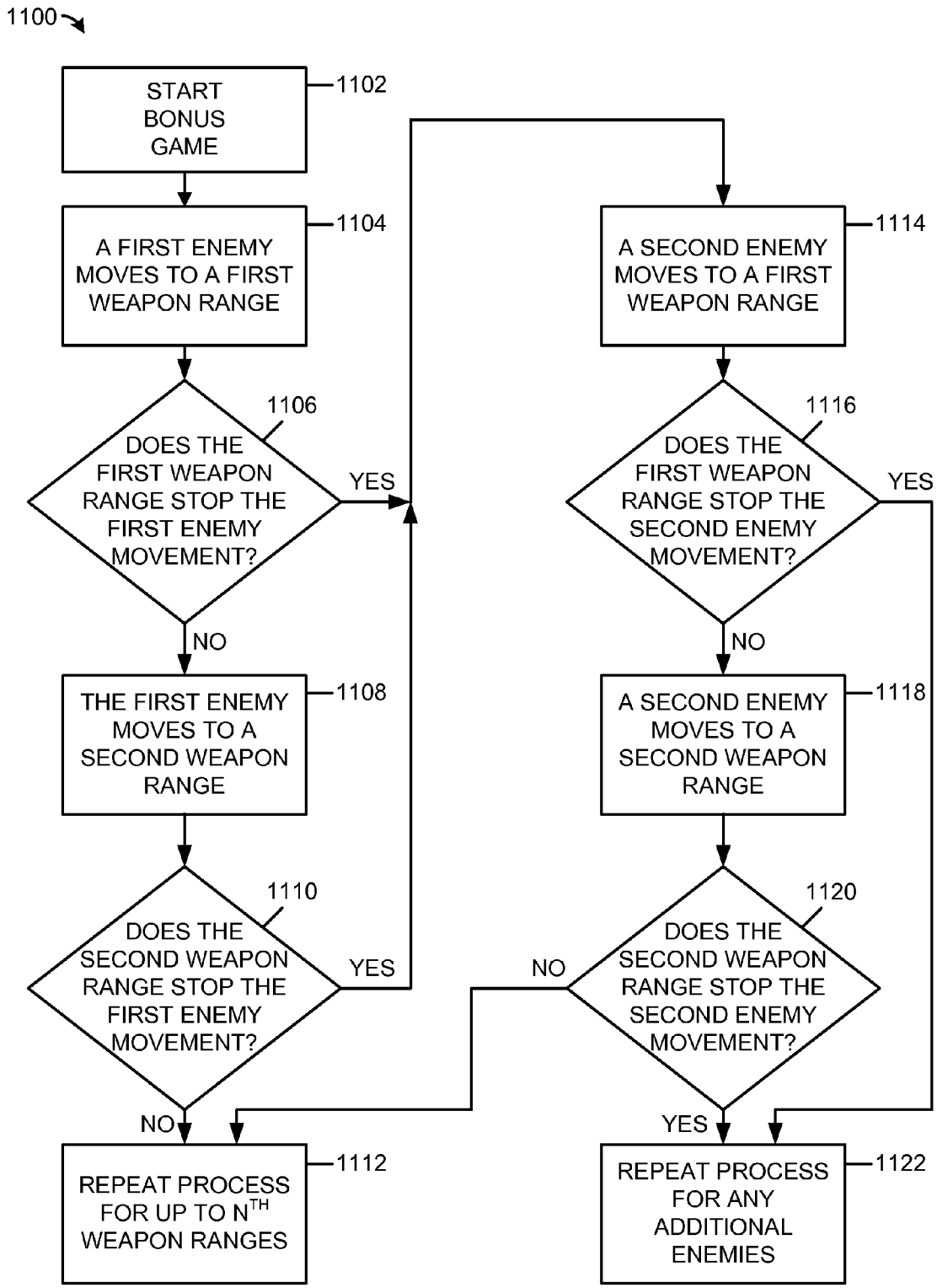
FIG. 11 is another flow diagram for game play, according to one embodiment.

FIG. 11 is another flow diagram for game play 1100, according to one embodiment. The method may include starting a bonus game (step 1102). The method may include a first enemy (e.g., a first object, a first stopping object, a first bonus game ending object, etc.) moving into a first weapon range (e.g., a second object, a first eliminating a first object element, etc.) (step 1104). The method may include electronic gaming device 100 and/or electronic gaming system 200 determining whether the first weapon range stopped the first enemy movement (step 1106). If the first enemy movement is stopped, then the method may move to step 1114. If the first enemy movement is not stopped, then the method may include the first enemy moving to a second weapon range (e.g., a third object, a second eliminating a first object element, etc.) (step 1108). The method may include electronic gaming device 100 and/or electronic gaming system 200 determining whether the second weapon range stopped the first enemy movement (step 1106). If the first enemy movement is stopped, then the method may move to step 1114. If the first enemy movement is not stopped, then the method may repeat the process (step 1104 to step 1110) (step 1112).

The method may include a second enemy (e.g., a fourth object, a second stopping object, a second bonus game ending object, etc.) moving to the first weapon range (step 1114). The method may include electronic gaming device 100 and/or electronic gaming system 200 determining whether the first weapon range stopped the second enemy movement (step 1116). If the second enemy movement is stopped, then the method may repeat the process for any additional enemies (step 1122). If the second enemy movement is not stopped, then the method may include the second enemy moving to the second weapon range (step 1118). The method may include electronic gaming device 100 and/or electronic gaming system 200 determining whether the second weapon range stopped the second enemy movement (step 1120). If the second enemy movement is stopped, then the method may repeat the process for any additional enemies (step 1122). If the second enemy movement is not stopped, then the method may move to step 1112.

Figure 12A:
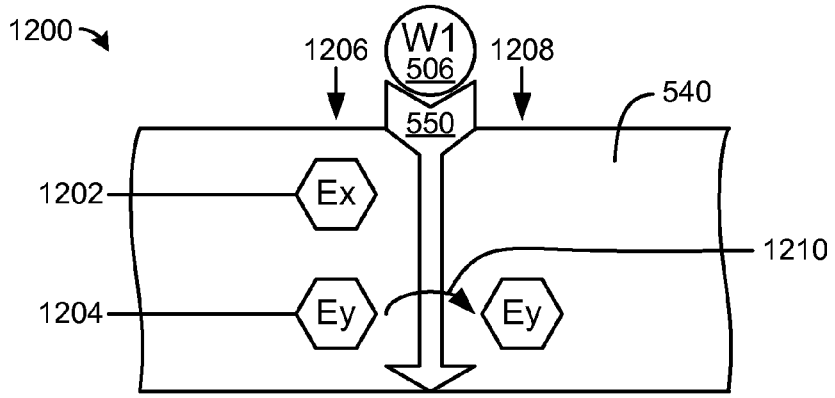
FIG. 12A is an illustration of weapon, range, and enemy interactions, according to one embodiment.

FIG. 12A is an illustration of weapon, range, and enemy interactions, according to one embodiment. A first image 1200 may include a first area 1206, a second area 1208, first weapon 506, first firing range 550, a first enemy 1202, and a second enemy 1204. In this example, first enemy 1202 may be stopped (e.g., eliminated) by first weapon 506 and/or first firing range 550 in first area 1206.

In another example, second enemy 1204 may bypass first firing range 550 by jumping over 1210 first firing range 550 into second area 1208. The ability to jump over a firing range may be based on a size of the object and/or any other object characteristic (e.g., swinging ability, strength, etc.). For example, a small object may not be able to jump over the firing range. Whereas, a larger object may be able to jump over the firing range (or a pit, a trap, etc.).

Figure 12B:
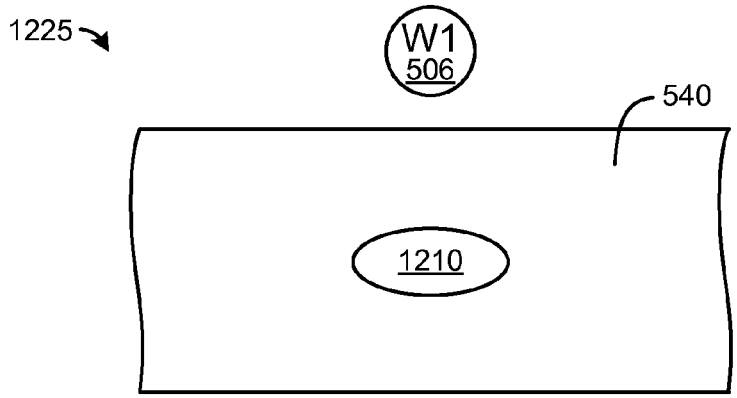
FIG. 12B is another illustration of weapon, range, and enemy interactions, according to one embodiment.

FIG. 12B is another illustration of weapon, range, and enemy interactions, according to one embodiment. A second image 1225 may include first weapon 506 with a shell firing range 1210. Shell firing range 1210 may be a firing range that is an island type firing area, which may eliminate one or more objects within the firing range.

Figure 12C:
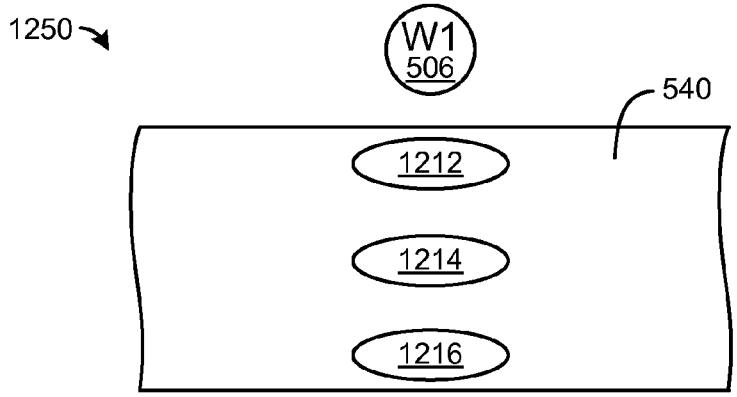
FIG. 12C is another illustration of weapon, range, and enemy interactions, according to one embodiment.

FIG. 12C is another illustration of weapon, range, and enemy interactions, according to one embodiment. A third image 1250 may include first weapon 506 with a first shell firing range 1212, a second shell firing range 1214, and a third shell firing range 1216.

Each item may relate to one or more presentation elements (e.g., visual elements and audio elements) and/or one or more multipliers (or other prize). For example, an item may include a red weapon, a six times multiplier, and/or a blue weapon. In one example, one or more weapons (e.g., objects) may include visual data (e.g., size, firing direction, firing pattern, etc.) and audio data (e.g., a weapon's sound, a target hit sound, etc.).

Each presentation may include numerous items (e.g., red weapon, blue weapon, green weapon, bonus multiplier, red pirate, green pirate, blue pirate, whammy pirate, starting pirate, ending pirate, save images, etc.). Each presentation may also include sound levels, various sound (e.g., gun fire, cannon fire, pirate sounds, ship noises, attacking sounds, injury sounds, people speaking, animal sounds, etc.). For example, a presentation may include red weapon, blue weapon, green weapon, bonus multiplier, red pirate, green pirate, blue pirate, whammy pirate, and ending pirate.

For example, a save image (e.g., fairy, angel, etc.) may provide help to one or more of the objects to increase game play payouts. In one example, a pirate may be close to ending game play and the angel may be displayed to eliminate this pirate. In another example, an object may be traveling along a path and get stuck in quick sand and a fairy may be displayed to help the object (e.g., a person) out of the quick sand. In another embodiment, a branch may fall to help the object out of the quick sand.

In one example, a first element may represent a medium sized red pirate moving from a first position in a first pattern. In another example, a second element may represent a large sized red pirate moving from a second position in a second pattern. In another example, a third element may represent a red supersized cross-bow aimed at a first position and having a first firing pattern. In another example, a fourth element may represent a blue small sized boat moving from a first position, in a first pattern, and able to pick up a small sized load.

In another example, a fifth element may be a brown haired medium sized person moving from a first position, at a first speed, and in a first pattern. In another example, a sixth element may be a blonde haired small sized person moving from a second position, at a second speed, and in a second pattern. In another example, a seventh element may be an animal (e.g., dog) moving from a third position, at a third speed, and in a third pattern. In should be noted that these individual elements may interact in the presentation.

In another example, an eighth element may be a blue pirate entering the presentation. In another example, a ninth element may be a red pirate entering the presentation. In another example, a tenth element may be a green pirate entering the presentation.

One or more presentations may be based on a first theme (e.g., pirates), a second theme (e.g., cars), a third theme (e.g., horses), a fourth theme (e.g., perceived skill), a fifth theme (e.g., a specific movie), a sixth theme (e.g., a sporting event), a seventh theme (e.g., outer space), an eight theme (e.g., flowers), a ninth theme (e.g., food), a tenth theme (e.g., a skill based presentation), an eleventh theme (e.g., trivia), a twelve theme (e.g., pick a bonus), a thirteenth theme (e.g., ghost), a fourteenth theme (e.g., natural events), on a fifteenth theme (e.g., a mineral—gold, silver, etc.), and/or a sixteenth theme (e.g., mythology). One, a few, a plurality, and/or all of these presentations may be themed based.

In one example, the method may include determining a triggering event (e.g., a winning credit amount). The method may include looking up one or more presentations relating to the triggering event (e.g., a winning credit amount). The method may include selecting one or more presentations from the one or more presentations related to the triggering event (e.g., a winning credit amount) based on one or more criteria. The method may include displaying the selected one or more presentations. The method may end.

In one example, the system and/or method may determine that a key value (e.g., winning amount) is 10,000 credits. The key value may be the amount of credits (and/or multipliers and/or free spins and/or any other item of value) won. In this example, the 10,000 credit key value number may be utilized to determine one or more presentations associated with this 10,000 credits key value number. There may be presentation indexes numbered 0 to N associated with the 10,000 credits key value number.

The system and/or method may select (e.g., randomly, by a predetermined pattern, shuffle, combination thereof, and/or any other selection method) one or more of the presentations based on the key value.

In one example, the method may include determining a winning credit amount. The method may include looking up one or more presentations related to the winning credit amount. The method may include modifying the set of presentations relating to the winning credit amount based on one or more criteria. The method may include selecting a presentation from the modified set of presentations based on one or more criteria. The method may include displaying the selected presentation. The method may end.

For example, the presentation may be modified to include an advertisement, a movie trailer, a movie promotion, a casino event, a casino promotion, an actor's image, the player's image, etc.

In one embodiment, the electronic gaming device may include a plurality of reels, one or more paylines formed on at least a portion of the plurality of reels, a memory, and a processor. The memory may include a presentation module. The presentation module may include a plurality of presentations. The processor may determine a value. The processor may select one or more presentations based on the value.

In another example, the processor may randomly select the one or more presentations related to the value. In an example, the processor may select the one or more presentations related to the value in a predetermined pattern.

In another example, the value may be based on an input from a player. In an example, the processor may display a presentation based on one or more presentations. In another example, the processor may display a themed presentation based on one or more criteria. In an example, the themed presentation may be based on an advertisement and/or any other theme.

In another embodiment, the method of providing gaming options via an electronic gaming device may include receiving one or more primary wagers on one or more paylines, starting a bonus game, determining one or more values, and/or selecting one or more presentations based on the one or more values.

In an exemplary embodiment, an electronic gaming device may include a plurality of reels. The plurality of reels may include a plurality of symbols. The electronic gaming device may include a first payline, a second payline, and a memory. The memory may include a payline module. The payline module may include a plurality of payline structures. The electronic gaming device may include a processor. The processor may receive primary wagers on one or more paylines. The processor may receive one or more secondary wagers on one or more selected paylines (e.g., repeat paylines, patterns, scenarios, etc.). The selected paylines may be based on data received from a player. The processor may determine a selected payline's payout based on the one or more selected paylines (e.g., repeat paylines, patterns, scenarios, etc.).

In another embodiment, the processor may determine a payout based on the primary wagers. The electronic gaming device may include a network interface, which may receive data from at least one of a server and one or more gaming devices. The electronic gaming device may include a display, which may display one or more selected paylines.

In another example, the display may shade one or more non-selected paylines. The electronic gaming device may include a player preference input device. The player preference input device may modify a game configuration based on data from an identification device. The processor may multiply a prize value based on a selected payline occurrence.

In another embodiment, a method of game play may include receiving one or more primary wagers on one or more paylines. The method may include receiving a secondary wager on one or more paylines (e.g., repeat paylines, patterns, scenarios, etc.). The selected payline may be based on selection data. The selection data may be based on player input. The method may include determining one or more primary wager payouts. Further, the method may include determining one or more secondary wager payouts.

In another example, the method may include obtaining a player preference data and modifying a game configuration based on the player preference data. The method may include receiving data from at least one of a server and one or more gaming devices. The method may include multiplying a prize value based on a selected payline occurrence.

In one embodiment, the electronic gaming device may include a plurality of reels. The plurality of reels may include a plurality of symbols. One or more paylines may be formed on a portion of the plurality of reels. The electronic gaming device may include a memory. The memory may include a payline module. The payline module may include a plurality of payline structures. The electronic gaming device may include a processor, which receives primary wagers on one or more paylines. The processor may also receive one or more secondary wagers on one or more repeat paylines. The processor may determine one or more repeat payline payouts based on the one or more repeat paylines.

In another example, the processor may determine a payout based on the primary wagers. The processor may receive one or more secondary wagers on one or more patterns. The electronic gaming device may include a display, which may display a game status image.

In another example, the display may shade one or more completed repeat paylines. The electronic gaming device may include a player preference input device. The player preference input device may modify a game configuration based on data from an identification device. In another embodiment, the processor may multiply a prize value based on a repeat payline occurrence.

In an embodiment, a method may include receiving one or more primary wagers on one or more paylines. The method may include receiving a secondary wager on one or more repeat paylines. The method also may include determining one or more primary wager payouts. The method may include determining one or more secondary wager payouts.

In another example, a primary wager payout may be based on the one or more paylines and a secondary wager payout may be based on the one or more repeat paylines. The method may include receiving one or more secondary wagers on one or more patterns.

In another example, the method may include displaying a game status image. The method may also include shading one or more completed objectives (e.g., selecting any element, obtaining a repeat payline, etc.).

In another example, the method may include displaying paylines based on the one or more primary wagers. The method may include displaying the one or more repeat paylines. The method may include highlighting one or more repeat paylines. The method may include obtaining a player preference data and modifying a game configuration based on the player preference data.

In another embodiment, the electronic gaming system may include a server. The server may include a server memory, a server processor, and a signage server. The server memory may include historical gaming data. The server processor may generate a gaming message based on the historical gaming data. The signage server may transmit the gaming message.

In another example, the gaming message may be transmitted to an internal display of a gaming entity. The internal display may be a non-gaming device display. The gaming message may be transmitted to an external display of a gaming entity. The external display may be located outside of a gaming entity. The gaming message may be transmitted to at least one of a top display, a main display, and a side display.

The plurality of reels may form a 5-by-5 matrix, a 3-by-5 matrix, a 4-by-5 matrix, a 4-by-3 matrix, a 5-by-3 matrix, or any number-by-any number matrix. The symbols may be an image of a card, an image, and/or other objects. For example, it could be a pot of gold, an ace of spades, a diamond, or any other symbol. The symbols may be animation. The symbols may be a picture. For example, it may be a picture of the player as taken by camera 312. The symbols may be a number. The symbols may be any image. The symbols may be blank.

This element selection feature, repeat payline feature, the pattern feature, and/or any other feature may be part of the base game and/or a bonus game. In addition, this element selection feature, repeat payline feature, the pattern feature, and/or any other feature may be part of a base bet and/or may require an additional side bet (e.g., ante bet).

In one embodiment, the electronic gaming device may include a plurality of reels. One or more paylines may be formed on a portion of the plurality of reels. The electronic gaming device may include a memory. The memory may include a plurality of game ending objects and/or a plurality of game ending object stoppers. The electronic gaming device may include a processor which may obtain one or more game ending object stopper selections.

In another example, the processor may obtain one or more locations for the one or more game ending object stopper selections. The processor may place the one or more game ending object stopper selections in the one or more locations. The processor may obtain one or more characteristics (e.g., ranges) associated with the one or more game ending object stopper selections. The processor may determine one or more payouts based on at least one of game ending object selections and the one or more locations. The processor may display a presentation based on at least one of game ending object selections and the one or more locations. The processor may determine one or more payouts based on at least one of game ending object selections and the one or more locations.

In another embodiment, the method may include receiving one or more wagers on one or more paylines. The method may include determining one or more game ending object stopper selections. The method may include displaying the one or more game ending object stopper selections.

In another example, the method may include determining one or more locations for the one or more game ending object stopper selections. The method may include placing the one or more game ending object stopper selections in the one or more locations. The method may include determining one or more characteristics (e.g., ranges) associated with the one or more game ending object stopper selections. The method may include determining one or more payouts based on at least one of game ending object selections and the one or more locations.

The method may include displaying a presentation based on at least one of the game ending object selections and the one or more locations. The method may include the presentation being based on a theme.

In another embodiment, the electronic gaming system may include a server, which may include a server memory and a server processor. The server memory may include a plurality of game ending objects and/or a plurality of game ending object stoppers. The server processor may obtain one or more game ending object stopper selections. The server processor may obtain one or more locations for the one or more game ending object stopper selections. The server processor may place the one or more game ending object stopper selections in the one or more locations.

The server processor may obtain one or more characteristics (e.g., ranges) associated with the one or more game ending object stopper selections. The server processor may determine one or more payouts based on at least one of the game ending object selections and the one or more locations. The server processor may display a presentation based on at least one of the game ending object selections and the one or more locations.

Fast play button (e.g., an auto-selection input device) may be utilized to speed up the game, automate the game (e.g., electronic gaming device 100 and/or electronic gaming system 200 selects the object), and/or reduce the presentations.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game.

Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming device comprising:

a credit device configured to accept a physical item associated with a monetary value;

a user input device configured to enable a player to select a wager amount and initiate a game play where the wager amount is subtracted from a credit balance, the credit balance being funded at least in part via the credit device;

at least one electronic video display;

at least one memory device; and at least one processor configured to receive a plurality of instructions from the at least one memory device, which when executed by the at least one processor, cause the at least one processor to:

cause said at least one electronic video display to display a path of object travel;

receive selection by said player of at least one weapon element and a weapon angle and a weapon range relative to said at least one weapon element, wherein said selection of said weapon angle and weapon range comprises a selection of one of at least two options having associated ranges which are not visible to the player;

receive selection by said player of a location for said at least one weapon element along said path;

cause said at least one electronic video display to display movement of at least one object along said path;

determine an interaction of said at least one weapon element with said at least one object based upon at least said location of said at least one weapon, said weapon angle, and said weapon range; and generate an award if said interaction results in said object being stopped, said award being credited to increase said credit balance.

2. The electronic gaming device in accordance with claim 1 wherein said step of receiving selection by said player of a weapon angle and weapon range comprises displaying said at least two options and receiving input from said player of one of said at least two options.

3. The electronic gaming device in accordance with claim 1 wherein said at least two options comprise at least two different directions each having a range which is not visible to the player.

4. The electronic gaming device in accordance with claim 1 wherein said step of determining an interaction is further based upon a weapon-object relationship.

5. The electronic gaming device in accordance with claim 4 wherein said weapon-object relationship includes a determination of whether said weapon is effective in stopping said object.

6. The electronic gaming device in accordance with claim 1 wherein said interaction results in said object being stopped if said object is in the range of said weapon and along said weapon angle.

7. A method of game play at an electronic gaming device comprising:

receiving via at least one wager accepting device an input of a physical item associated with a monetary value to establish a credit balance;

receiving input of a wager from the credit balance by a player of said electronic gaming device;

initiating play of a game at said electronic gaming device in response to said wager;

causing at least one electronic video display to display a path of object travel;

receiving selection by said player of at least one weapon element and a weapon angle and a weapon range relative to said at least one weapon element, wherein said selection of said weapon angle and weapon range comprises a selection of one of at least two options having associated ranges which are not visible to the player;

receiving selection by said player of a location for said at least one weapon element along said path;

causing said at least one electronic video display to display movement of at least one object along said path;

determining an interaction of said at least one weapon element with said at least one object based upon at least said location of said at least one weapon, said weapon angle, and said weapon range; and generating an award if said interaction results in said object being stopped, said award being credited to said credit balance.

8. The method in accordance with claim 7 wherein said step of receiving selection by said player of a weapon angle and weapon range comprises displaying said at least two options and receiving input from said player of one of said at least two options.

9. The method in accordance with claim 7 wherein said at least two options comprise at least two different directions each having a range which is not visible to the player.

10. The method in accordance with claim 7 wherein said step of determining an interaction is further based upon a weapon-object relationship.

11. The method in accordance with claim 10 wherein said weapon-object relationship includes a determination of whether said weapon is effective in stopping said object.

12. The method in accordance with claim 7 wherein said interaction results in said object being stopped if said object is in the range of said weapon and along said weapon angle.

* * * * *